US008727526B2

(12) United States Patent
Yamamoto et al.

(10) Patent No.: US 8,727,526 B2
(45) Date of Patent: May 20, 2014

(54) INKJET PRINTING APPARATUS

(75) Inventors: Kosuke Yamamoto, Yokohama (JP); Tetsuya Saito, Yokohama (JP); Yoshiaki Suzuki, Nagareyama (JP); Koji Furusawa, Kawasaki (JP); Hiroshi Tajika, Yokohama (JP); Masahiko Watanabe, Yokohama (JP); Atsuhiko Masuyama, Yokohama (JP); Atsushi Miyahara, Higashikurume (JP); Masashi Ito, Yokohama (JP); Fumie Kameyama, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 201 days.

(21) Appl. No.: 13/090,681

(22) Filed: Apr. 20, 2011

(65) Prior Publication Data

US 2011/0267396 A1 Nov. 3, 2011

(30) Foreign Application Priority Data

Apr. 30, 2010 (JP) ..... 2010-105696

(51) Int. Cl.

| | |
|---|---|
| ***B41J 29/38*** | (2006.01) |
| ***B41J 2/01*** | (2006.01) |
| ***B41J 11/00*** | (2006.01) |
| *B41J 11/42* | (2006.01) |
| *B41J 29/393* | (2006.01) |
| *B41J 2/045* | (2006.01) |
| *B41J 11/06* | (2006.01) |

(52) U.S. Cl.

CPC ..... *B41J 11/002* (2013.01); *B41J 11/0015* (2013.01); *B41J 11/42* (2013.01); *B41J 29/393* (2013.01); *B41J 2/04563* (2013.01); *B41J 11/007* (2013.01); *B41J 11/06* (2013.01)

USPC ..... 347/102; 347/16; 347/17; 347/104

(58) Field of Classification Search

None

See application file for complete search history.

(56) References Cited

U.S. PATENT DOCUMENTS 5,214,442 A * 5/1993 Roller ..... 347/102
5,621,149 A * 4/1997 Schwindeman et al. ..... 568/659

(Continued)

FOREIGN PATENT DOCUMENTS

JP 05-270100 A 10/1993
JP 3036504 B2 4/2000

(Continued)

OTHER PUBLICATIONS

Office Action mailed Dec. 17, 2013, in Japanese Patent Application No. 2010-105696, Japanese Patent Office.

*Primary Examiner* — Alessandro Amari
*Assistant Examiner* — Leonard S Liang
(74) *Attorney, Agent, or Firm* — Fitzpatrick, Cella, Harper & Scinto

(57) ABSTRACT

In an inkjet printing apparatus capable of automatic duplex printing, time required to fix ink is shortened and throughput is improved without producing uneven fixing. The inkjet printing apparatus includes a printing unit that prints onto a sheet, a fixing unit that heats a sheet printed by the printing unit, a conveying unit that conveys a sheet with respect to the printing unit and the fixing unit, and a controller that controls the conveying unit such that a printing region of a sheet printed on the first side by the printing unit passes through the fixing unit, and afterwards, the conveyance direction of the sheet is reversed in order to print on the second side and the printing region once again passes through the fixing unit. The controller variably controls the conveyance speed of the sheet when the printing region once again passes through the fixing unit.

10 Claims, 16 Drawing Sheets

(56) References Cited

U.S. PATENT DOCUMENTS

| | | | | |
|---|---|---|---|---|
| 6,644,652 | B1 * | 11/2003 | Walsh et al. | 271/186 |
| 6,729,710 | B2 * | 5/2004 | Chikuma et al. | 347/14 |
| 7,108,368 | B2 * | 9/2006 | Saito et al. | 347/104 |
| 7,270,392 | B2 * | 9/2007 | Mizuno | 347/19 |
| 7,277,670 | B2 * | 10/2007 | Yuasa | 399/401 |
| 7,360,857 | B2 | 4/2008 | Koshikawa | |
| 7,377,632 | B2 | 5/2008 | Kachi | |
| 7,396,122 | B2 | 7/2008 | Masumi et al. | |
| 2005/0253886 | A1 * | 11/2005 | Nakajima et al. | 347/16 |
| 2006/0050099 | A1 * | 3/2006 | Murakami et al. | 347/19 |
| 2007/0030299 | A1 * | 2/2007 | Izuchi | 347/16 |
| 2009/0284560 | A1 * | 11/2009 | Takahashi | 347/16 |
| 2009/0303273 | A1 * | 12/2009 | Okamoto | 347/16 |
| 2010/0156981 | A1 * | 6/2010 | Chikuma et al. | 347/14 |
| 2010/0194839 | A1 * | 8/2010 | Taguchi et al. | 347/179 |

FOREIGN PATENT DOCUMENTS

| | | | |
|---|---|---|---|
| JP | 2004-306589 | A | 11/2004 |
| JP | 2005-288905 | A | 10/2005 |
| JP | 2005-349710 | A | 12/2005 |
| JP | 2008-080808 | A | 4/2008 |

* cited by examiner

FIG.4

FIG.4A

FIG.4B

| CONVEYANCE DIRECTION AREA NUMBER | MAXIMUM DUTY IN AREA (%) | FIXING DWELL TIME FOR FRONT SIDE PRINTING (s) | REQUIRED POST-REVERSAL FIXING DWELL TIME (s) |
|---|---|---|---|
| 1~3 | 25 OR LESS | 1 OR LESS | 0 |
| | ↓ | 0.5 OR LESS | 0.4 |
| | ↓ | 0.2 OR LESS | 0.7 |
| | 50 OR LESS | 1 OR LESS | 0.4 |
| | ↓ | 0.5 OR LESS | 0.9 |
| | ↓ | 0.2 OR LESS | 1.2 |
| | 75 OR LESS | 1 OR LESS | 1.9 |
| | ↓ | 0.5 OR LESS | 2.4 |
| | ↓ | 0.2 OR LESS | 2.7 |
| | 100 OR LESS | 1 OR LESS | 3.9 |
| | ↓ | 0.5 OR LESS | 4.4 |
| | ↓ | 0.2 OR LESS | 4.7 |
| 4~6 | 25 OR LESS | 1 OR LESS | 0 |
| | ↓ | 0.5 OR LESS | 0.5 |
| | ↓ | 0.2 OR LESS | 0.8 |
| | 50 OR LESS | 1 OR LESS | 0.5 |
| | ↓ | 0.5 OR LESS | 1 |
| | ↓ | 0.2 OR LESS | 1.3 |
| | 75 OR LESS | 1 OR LESS | 2 |
| | ↓ | 0.5 OR LESS | 2.5 |
| | ↓ | 0.2 OR LESS | 2.8 |
| | 100 OR LESS | 1 OR LESS | 4 |
| | ↓ | 0.5 OR LESS | 4.5 |
| | ↓ | 0.2 OR LESS | 4.8 |

FIG.4A

| | | | |
|---|---|---|---|
| 7~9 | 25 OR LESS | 1 OR LESS | 0.1 |
| | | 0.5 OR LESS | 0.6 |
| | | 0.2 OR LESS | 0.9 |
| | 50 OR LESS | 1 OR LESS | 0.6 |
| | | 0.5 OR LESS | 1.1 |
| | | 0.2 OR LESS | 1.4 |
| | 75 OR LESS | 1 OR LESS | 2.1 |
| | | 0.5 OR LESS | 2.6 |
| | | 0.2 OR LESS | 2.9 |
| | 100 OR LESS | 1 OR LESS | 4.1 |
| | | 0.5 OR LESS | 4.6 |
| | | 0.2 OR LESS | 4.9 |
| 10~11 | 25 OR LESS | 1 OR LESS | 0.2 |
| | | 0.5 OR LESS | 0.7 |
| | | 0.2 OR LESS | 1 |
| | 50 OR LESS | 1 OR LESS | 0.7 |
| | | 0.5 OR LESS | 1.2 |
| | | 0.2 OR LESS | 1.5 |
| | 75 OR LESS | 1 OR LESS | 2.2 |
| | | 0.5 OR LESS | 2.7 |
| | | 0.2 OR LESS | 3 |
| | 100 OR LESS | 1 OR LESS | 4.2 |
| | | 0.5 OR LESS | 4.7 |
| | | 0.2 OR LESS | 5 |

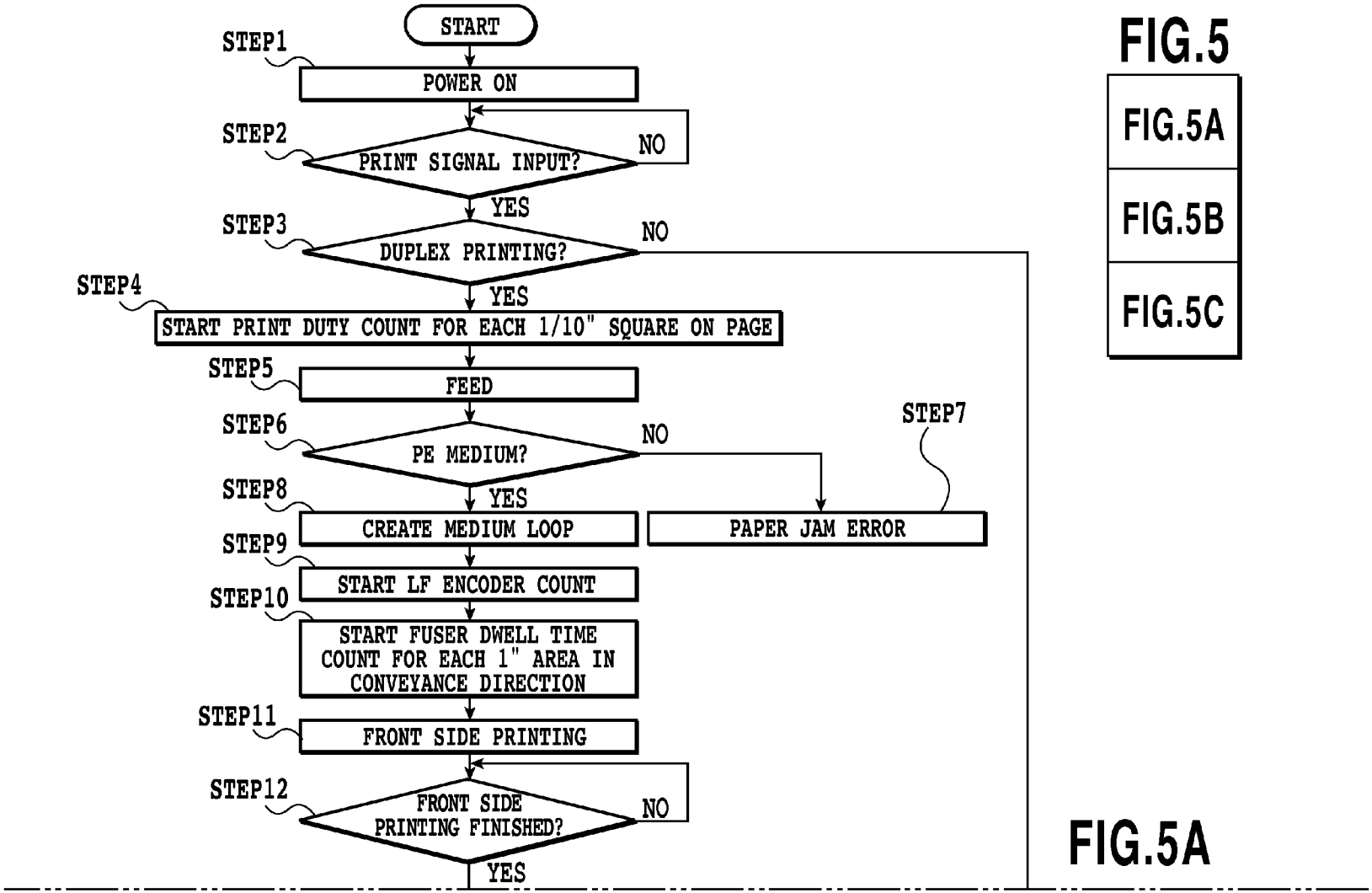
FIG.5
FIG.5A
FIG.5B
FIG.5C
START
POWER ON
STEP1
PRINT SIGNAL INPUT?
STEP2
NO
YES
DUPLEX PRINTING?
STEP3
NO
YES
START PRINT DUTY COUNT FOR EACH 1/10" SQUARE ON PAGE
STEP4
FEED
STEP5
PE MEDIUM?
STEP6
NO
YES
PAPER JAM ERROR
STEP7
CREATE MEDIUM LOOP
STEP8
START LF ENCODER COUNT
STEP9
START FUSER DWELL TIME COUNT FOR EACH 1" AREA IN CONVEYANCE DIRECTION
STEP10
FRONT SIDE PRINTING
STEP11
FRONT SIDE PRINTING FINISHED?
STEP12
NO
YES
FIG.5A

FIG.9

FIG.9A

FIG.9B

| CONVEYANCE DIRECTION AREA NUMBER | MAXIMUM DUTY IN AREA (%) | FURNACE DWELL TIME FOR FRONT SIDE PRINTING (s) | REQUIRED POST-REVERSAL FURNACE DWELL TIME (s) USER ADJUSTMENT "Standard" | REQUIRED POST-REVERSAL FURNACE DWELL TIME (s) USER ADJUSTMENT "Dry 1" | REQUIRED POST-REVERSAL FURNACE DWELL TIME (s) USER ADJUSTMENT "Dry 2" |
|---|---|---|---|---|---|
| 1~3 | 25 OR LESS | 1 OR LESS | 0 | 0.5 | 1 |
| | ↓ | 0.5 OR LESS | 0.4 | 0.9 | 1.4 |
| | ↓ | 0.2 OR LESS | 0.7 | 1.2 | 1.7 |
| | 50 OR LESS | 1 OR LESS | 0.4 | 0.9 | 1.4 |
| | ↓ | 0.5 OR LESS | 0.9 | 1.4 | 1.9 |
| | ↓ | 0.2 OR LESS | 1.2 | 1.7 | 2.2 |
| | 75 OR LESS | 1 OR LESS | 1.9 | 2.4 | 2.9 |
| | ↓ | 0.5 OR LESS | 2.4 | 2.9 | 3.4 |
| | ↓ | 0.2 OR LESS | 2.7 | 3.2 | 3.7 |
| | 100 OR LESS | 1 OR LESS | 3.9 | 4.4 | 4.9 |
| | ↓ | 0.5 OR LESS | 4.4 | 4.9 | 5.4 |
| | ↓ | 0.2 OR LESS | 4.7 | 5.2 | 5.7 |
| 4~6 | 25 OR LESS | 1 OR LESS | 0 | 0.5 | 1 |
| | ↓ | 0.5 OR LESS | 0.5 | 1 | 1.5 |
| | ↓ | 0.2 OR LESS | 0.8 | 1.3 | 1.8 |
| | 50 OR LESS | 1 OR LESS | 0.5 | 1 | 1.5 |
| | ↓ | 0.5 OR LESS | 1 | 1.5 | 2 |
| | ↓ | 0.2 OR LESS | 1.3 | 1.8 | 2.3 |
| | 75 OR LESS | 1 OR LESS | 2 | 2.5 | 3 |
| | ↓ | 0.5 OR LESS | 2.5 | 3 | 3.5 |
| | ↓ | 0.2 OR LESS | 2.8 | 3.3 | 3.8 |
| | 100 OR LESS | 1 OR LESS | 4 | 4.5 | 5 |
| | ↓ | 0.5 OR LESS | 4.5 | 5 | 5.5 |
| | ↓ | 0.2 OR LESS | 4.8 | 5.3 | 5.8 |

FIG.9A

| | | | | | |
|---|---|---|---|---|---|
| 7~9 | 25 OR LESS | 1 OR LESS | 0.1 | 0.6 | 1.1 |
| | ↓ | 0.5 OR LESS | 0.6 | 1.1 | 1.6 |
| | ↓ | 0.2 OR LESS | 0.9 | 1.4 | 1.9 |
| | 50 OR LESS | 1 OR LESS | 0.6 | 1.1 | 1.6 |
| | ↓ | 0.5 OR LESS | 1.1 | 1.6 | 2.1 |
| | ↓ | 0.2 OR LESS | 1.4 | 1.9 | 2.4 |
| | 75 OR LESS | 1 OR LESS | 2.1 | 2.6 | 3.1 |
| | ↓ | 0.5 OR LESS | 2.6 | 3.1 | 3.6 |
| | ↓ | 0.2 OR LESS | 2.9 | 3.4 | 3.9 |
| | 100 OR LESS | 1 OR LESS | 4.1 | 4.6 | 5.1 |
| | ↓ | 0.5 OR LESS | 4.6 | 5.1 | 5.6 |
| | ↓ | 0.2 OR LESS | 4.9 | 5.4 | 5.9 |
| 10~11 | 25 OR LESS | 1 OR LESS | 0.2 | 0.7 | 1.2 |
| | ↓ | 0.5 OR LESS | 0.7 | 1.2 | 1.7 |
| | ↓ | 0.2 OR LESS | 1 | 1.5 | 2 |
| | 50 OR LESS | 1 OR LESS | 0.7 | 1.2 | 1.7 |
| | ↓ | 0.5 OR LESS | 1.2 | 1.7 | 2.2 |
| | ↓ | 0.2 OR LESS | 1.5 | 2 | 2.5 |
| | 75 OR LESS | 1 OR LESS | 2.2 | 2.7 | 3.2 |
| | ↓ | 0.5 OR LESS | 2.7 | 3.2 | 3.7 |
| | ↓ | 0.2 OR LESS | 3 | 3.5 | 4 |
| | 100 OR LESS | 1 OR LESS | 4.2 | 4.7 | 5.2 |
| | ↓ | 0.5 OR LESS | 4.7 | 5.2 | 5.7 |
| | ↓ | 0.2 OR LESS | 5 | 5.5 | 6 |

FIG.9B

| CONVEYANCE DIRECTION AREA NUMBER | MAXIMUM DUTY IN AREA (%) | REQUIRED WAIT TIME (s) |
|---|---|---|
| 1~3 | 25 OR LESS | 0 |
| | 50 OR LESS | 5 |
| | 75 OR LESS | 15 |
| | 100 OR LESS | 35 |
| 4~6 | 25 OR LESS | 0 |
| | 50 OR LESS | 3 |
| | 75 OR LESS | 13 |
| | 100 OR LESS | 33 |
| 7~9 | 25 OR LESS | 0 |
| | 50 OR LESS | 1 |
| | 75 OR LESS | 11 |
| | 100 OR LESS | 31 |
| 10~11 | 25 OR LESS | 0 |
| | 50 OR LESS | 0 |
| | 75 OR LESS | 9 |
| | 100 OR LESS | 29 |

FIG.12

INKJET PRINTING APPARATUS

BACKGROUND OF THE INVENTION

1. Field of the Invention

The present invention relates to an inkjet printing apparatus that forms an image by ejecting ink on a sheet while causing a print head to scan across the sheet.

2. Description of the Related Art

Since an inkjet printing apparatus ejects liquid ink onto a sheet from a print head, it is necessary to dry the ink with a fixing apparatus in order to fix ejected ink onto the sheet. The drying process for ink ejected onto a sheet affects print quality and throughput. For this reason, Japanese Patent Publication No. 3036504 and Japanese Patent Laid-Open No. H05-270100 (1993) disclose technology that optimizes a drying process by controlling factors such as the temperature and airflow of a fixing apparatus for fixing ink, and the sheet conveyance speed.

Meanwhile, in an inkjet printing apparatus capable of automatic duplex printing, ink fixing takes more time because more ink is used compared to one-sided printing, and thus there is a problem of reduced throughput. There are also limits on raising the temperature and airflow of a fixing apparatus in order to shorten ink fixing time.

Also, in a printing apparatus using a fixing apparatus, it is necessary to wait until the fixing apparatus temperature reaches a given temperature when the printing apparatus is activated, for example, and thus the wait time until the first printing is initiated becomes longer. Likewise, in such cases, there are limits on increasing the fixing apparatus's heater capacity to shorten the wait time.

SUMMARY OF THE INVENTION

An object of the present invention is to shorten the time required to fix ink and increase throughput without producing uneven fixing in an inkjet printing apparatus capable of automatic duplex printing. Also, another object of the present invention is to shorten the wait time required to raise fixing apparatus temperature and increase throughput without producing uneven drying in an inkjet printing apparatus.

An inkjet printing apparatus according to the present invention is an inkjet printing apparatus being capable of duplex printing on a first side and a second side of a sheet, and includes a printing unit that prints onto a sheet, a fixing unit that heats a sheet printed by the printing unit, a conveying unit that conveys a sheet with respect to the printing unit and the fixing unit, and a controller that controls the conveying unit such that a printing region of a sheet printed on the first side by the printing unit passes through the fixing unit, and afterwards, the conveyance direction of the sheet is reversed in order to print on the second side and the printing region once again passes through the fixing unit, wherein the controller variably controls the conveyance speed of the sheet when the printing region once again passes through the fixing unit.

According to the present invention, the time required to fix ink can be shortened and the throughput can be increased without producing uneven fixing.

Further features of the present invention will become apparent from the following description of exemplary embodiments (with reference to the attached drawings).

BRIEF DESCRIPTION OF THE DRAWINGS

FIG. 4 is a diagram showing the relationship of FIGS. 4A and 4B;

FIGS. 4A and 4B are exemplary tables for determining required dwell time in the first embodiment;

FIG. 5 is a diagram showing the relationship of FIGS. 5A to 5C;

FIGS. 5A to 5C are operational flowcharts in the first embodiment;

FIG. 9 is a diagram showing the relationship of FIGS. 9A and 9B;

FIGS. 9A and 9B are tables for determining required dwell time in the third embodiment;

FIG. 12 is a wait time determination table in a fifth embodiment.

DESCRIPTION OF THE EMBODIMENTS (First Embodiment)

Figure 1:
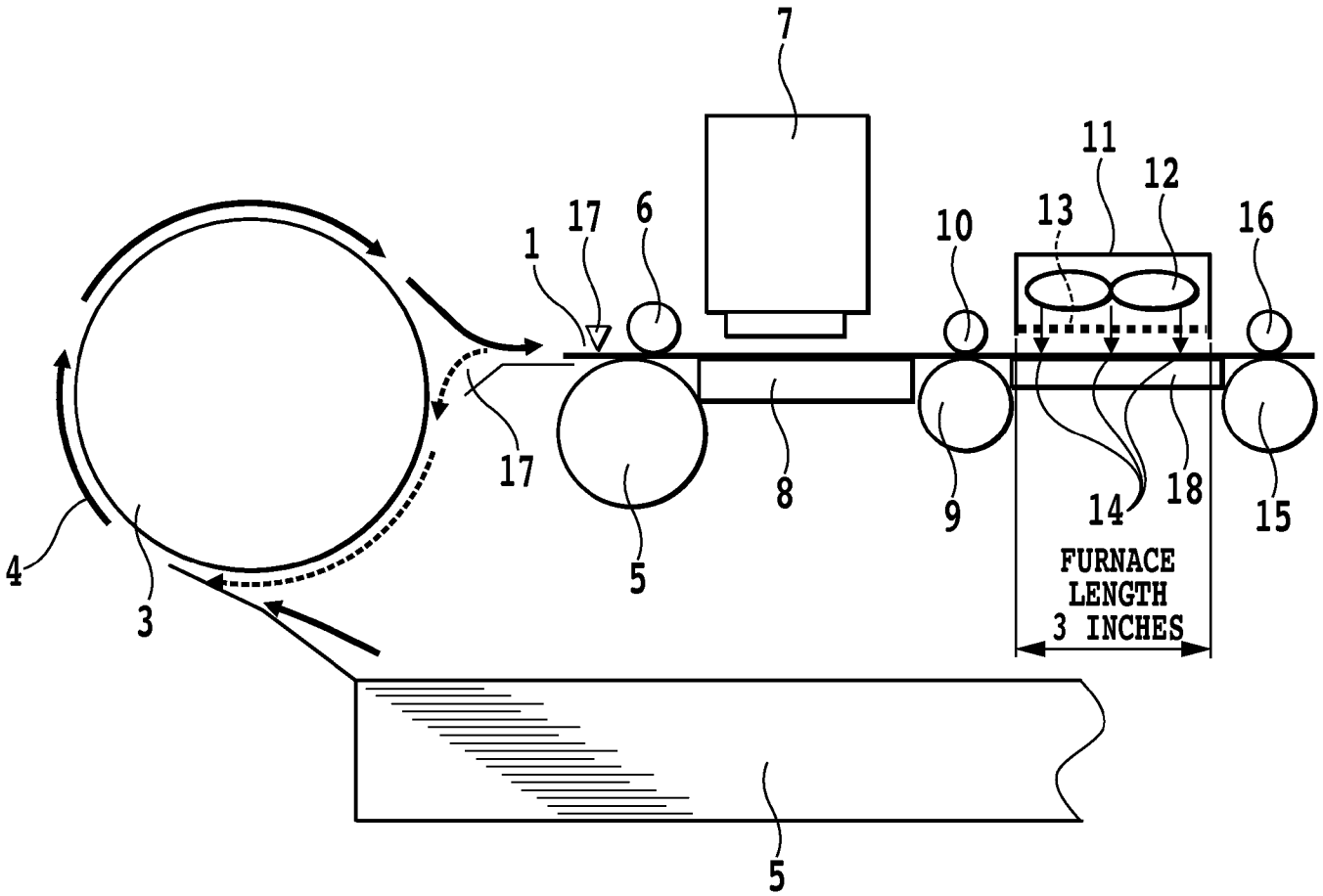
FIG. 1 illustrates a lateral view of the main part of a printer in accordance with a first embodiment of the present invention.

FIG. 1 is a configuration diagram of an inkjet printing apparatus (printer) of the present embodiment. This printer is able to print an image onto the front side of a sheet (first side), and then reverse the sheet and print an image onto the back side (second side).

A maximum of 250 sheets 1 can be set in a feed cassette 2. One sheet at a time is picked up by a feed roller and separating means not illustrated. A U-turn conveyance unit 3, together with a passive conveyance roller not illustrated, conveys a sheet in the direction of the solid arrows 4. This U-turn conveyance unit 3 also doubles as a duplex reversal unit. An inkjet print head 7 constitutes a printing unit. Any of a technique using a heating element, a technique using a piezoelectric element, a technique using a MEMS element, a technique using an electrostatic element, etc. is applicable as the inkjet technique.

A sheet 1 fed along the solid arrows 4 is held between an LE roller 5 and a pinch roller 6, and conveyed directly underneath the print head 7. An LE encoder not illustrated is coaxially coupled to the LF roller 5, and is able to detect at a resolution of 1/2400 inch by converting rotation of the LF roller 5 into sheet feed distance. A sheet passage sensor (hereinafter, sheet sensor) 17 disposed immediately before the LF roller 5 is able to optically detect the passage of the leading and trailing edges of a sheet. A platen 8 supports a sheet from below. A first discharging roller 9, together with a first passive roller 10, holds and conveys a sheet 1 that has passed directly underneath the print head 7.

A fixing apparatus 11 constitutes a fixing unit that heats a sheet printed by the printing unit while causing the sheet to pass through. During duplex printing, the fixing apparatus 11 is a shared single fixing apparatus used for both printing on the first side and printing on the second side of a sheet. The fixing apparatus 11 internally includes a blow fan 12 and a Nichrome wire heater 13. From the fixing apparatus 11, hot air of a given temperature, such as 80° C., for example, is vertically blown onto a sheet in the direction of the arrows 14, causing ink on the sheet to dry. A temperature sensor (thermistor) not illustrated is internally built into the fixing apparatus 11 and detects the hot air temperature. The length of this fixing apparatus 11 in the conveyance direction is 3 inches, for example. A second discharging roller 15 provided on the downstream side of the fixing apparatus, together with a second passive roller 16, holds and conveys a sheet 1 that has passed through the fixing apparatus 11. A discharging platen 18 provided opposite the fixing apparatus 11 supports a sheet from below, similarly to the platen 8. In this way, ink ejected from the head 7 can be dried with the fixing apparatus 11.

During duplex printing, the roller system is temporarily stopped with a sheet held between the first discharging roller and the first passive roller 10, and between the second discharging roller and the second passive roller 16. After that, the roller system is reversed, and after the trailing edge of the sheet during front side printing passes the LF roller 5, the sheet is conveyed along the broken arrows 17, wound around the U-turn conveyance unit 3, and once again held between the LF roller 5 and the pinch roller 6. At this time, the sheet 1 is reversed front to back, with the printed side facing down. After that, back side printing is conducted similarly to front side printing, the sheet is discharged into a discharge tray not illustrated by the second discharging roller and the second passive roller 16 via the fixing apparatus, and printing of a single page ends.

Figure 2:
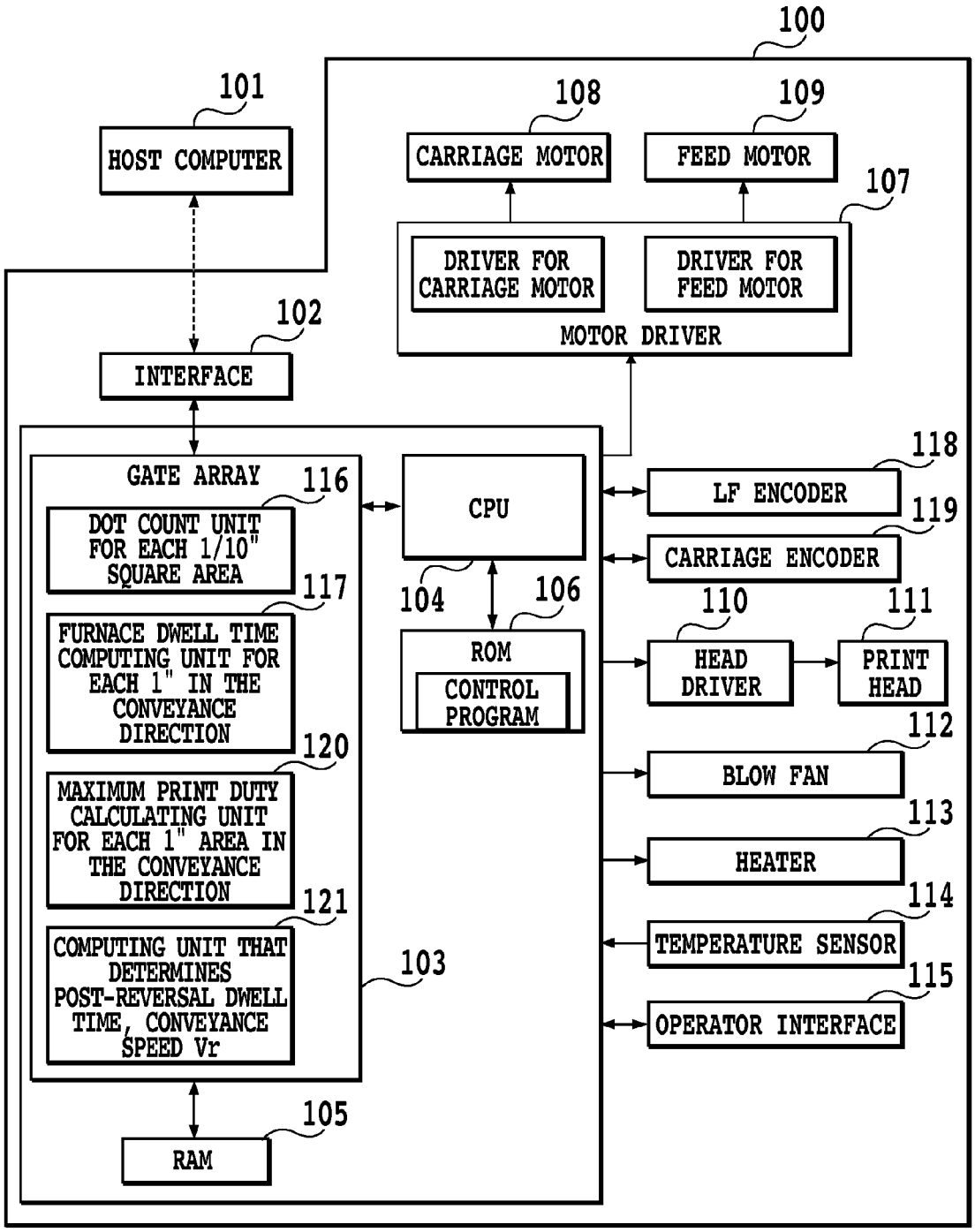
FIG. 2 is a block diagram illustrating the control system of the printer in FIG. 1.

FIG. 2 is a block diagram of a control unit for print control. 100 is a printer. An interface 102 provided in the printer couples an inkjet printer 100 and a host computer 101, receiving print data from the host computer 101 and sending back various status information to the host computer 101. 103 is a gate array, 104 is a CPU, 105 is RAM, and 106 is ROM. When print data is sent from the host computer 101, the data is temporarily stored in the RAM 105 via the gate array 103. After that, the print data is converted from raster data to a print image by the gate array 103, and once again stored in the RAM 105. The print image is sent to a print head 111 via the gate array 103 and a head driver 110, and printing is conducted by ejecting ink from the head. A dot count unit 116 is packaged on the gate array 103, and is able to count numbers of ejected dots in individual unit areas (division unit regions). Also, 117 is a computing unit that functions as dwell time computing means that computes the amount of time that 1 inch areas in the conveyance direction of a sheet (division unit regions) dwell in the fixing apparatus.

Figure 3:
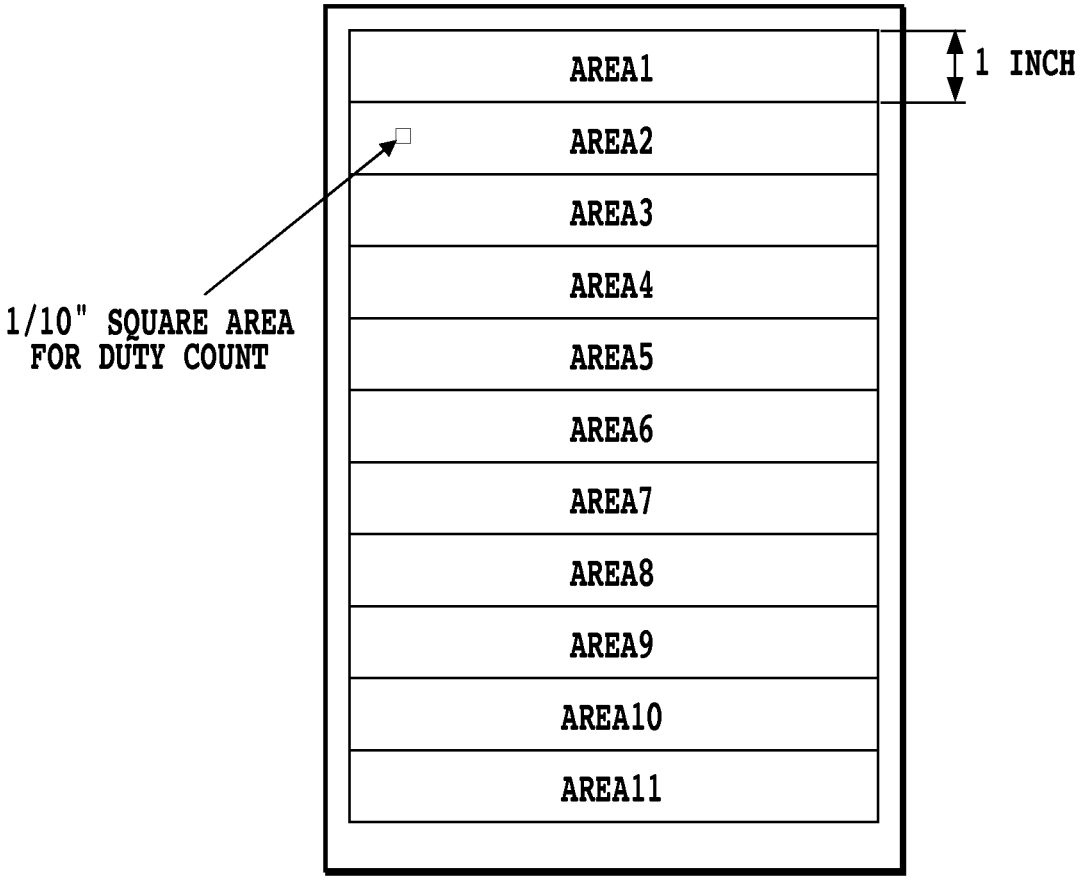
FIG. 3 illustrates area divisions for duty count and fixing dwell time computation.

FIG. 3 illustrates exemplary area divisions on a sheet for duty count and fixing dwell time calculation. According to a sequence described later, duty is counted for each 1/10 inch area (unit printing region) existing in each conveyance area in FIG. 3. The duty is a value that corresponds to the amount of ejected ink in a 1/10 inch area existing in each conveyance area. Also, areas from an area 1 to an area 11 are divided and recognized by counting an LF encoder signal. In the present embodiment, since various sheet sizes are supported, a maximum of 20 areas are reserved in memory. If the sheet length increases and a print image exists all the way to the trailing edge, the time between when ink is ejected onto a sheet and when sheet reversal is initiated, although constant for the trailing edge regardless of sheet length, becomes longer for the leading edge as the sheet length increases. During this time, the sheet is exposed outside the fixing apparatus and drying progresses. Consequently, in order to control the dwell time in the fixing apparatus after reversal while also taking into account the time until this reversal, it is favorable to take the trailing edge as a basis, and shorten the post-reversal dwell time while advancing toward the leading edge. In so doing, dwell time can be controlled on a uniform basis, regardless of sheet length.

Furthermore, the amount of time each conveyance area dwells inside the fixing apparatus can be computed from position information given by an LF encoder signal and a timer signal that starts when a sheet enters the furnace. 120 in FIG. 2 is a calculating unit that calculates the maximum print duty in each of the areas 1 to 11 from a count value of the dot count unit 116 and area division information for the areas 1 to 11. 121 is a computing unit that determines the required post-reversal dwell time in the fixing apparatus and a reversal speed Vr realizing that dwell time from information from the computing unit 117 that calculates dwell times and information from a maximum print duty calculating unit 120.

Figure 4B:
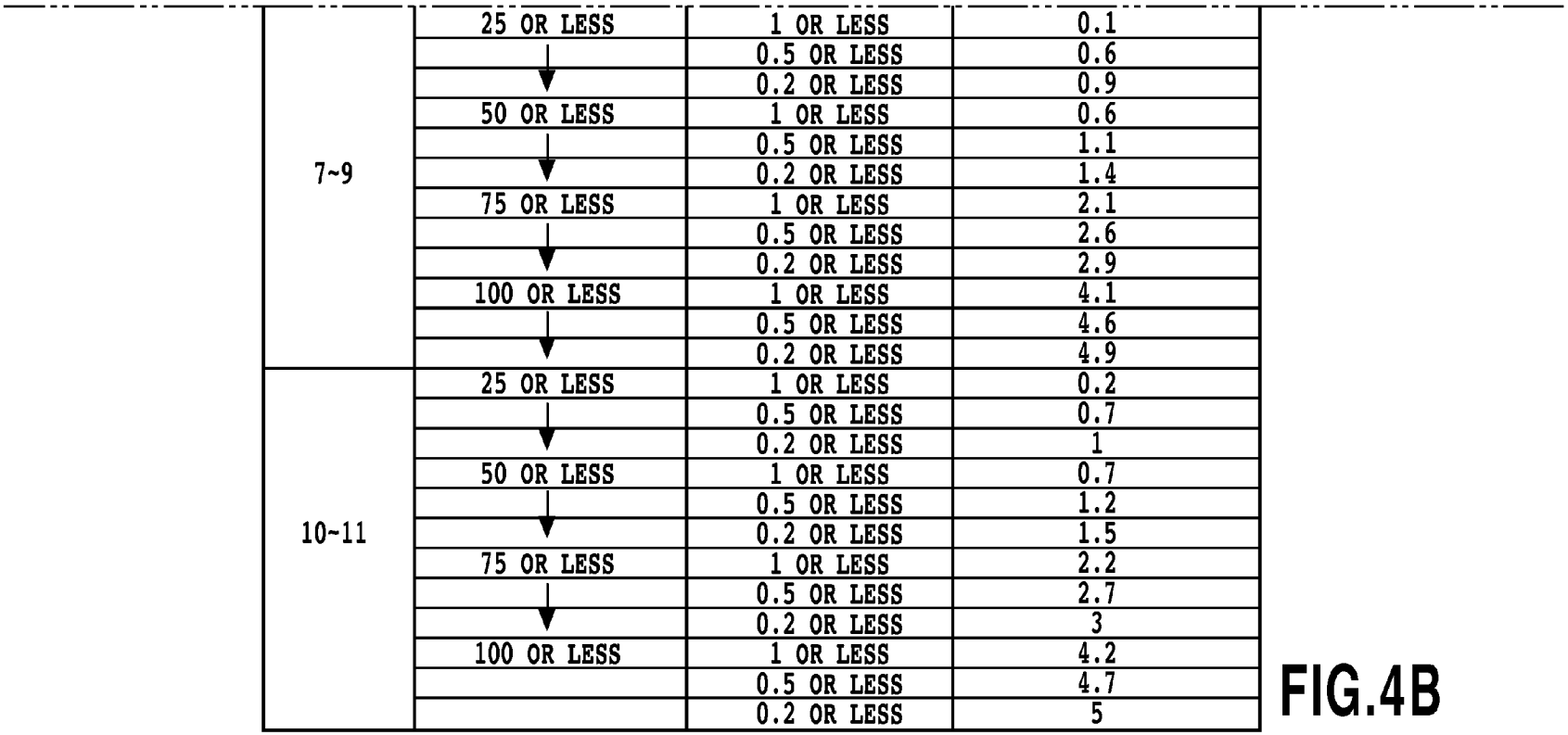

FIGS. 4A and 4B are tables for determining required dwell times. Required dwell times for each of the areas 1 to 11 are determined in accordance with this table, and stored as information in the RAM 105. This table divides conveyance direction area numbers into the four levels 1 to 3, 4 to 6, 7 to 9, and 10 to 11. As described earlier, required post-reversal fixing dwell times are determined with the last edge area 11 taken as a basis. The maximum duty in area (%) is divided into the four levels 25 or less, 50 or less, 75 or less, and 100 or less. The fixing dwell time during front side printing (s) is divided into the three levels of 1 s or less, 5 s or less, and 10 s or less.

Although finer control is possible with greater numbers of levels, in the case of the present embodiment, sufficient fixing effects are obtained with the above numbers of levels. The reason why combinations of levels exist for which the required post-reversal fixing dwell time is 0 is because fixing is satisfactory with natural drying. This corresponds to cases where front side printing takes time, such as cases where the duty is low and the printing is multi-pass.

Returning to FIG. 2, the ROM 106 stores various programs such as a printer control programs. These control programs are referenced by the CPU 104 to conduct control operations. 107 is a motor driver, and is a control circuit for controlling a carriage motor 108 and a feed motor 109 that conduct print operations of a serial inkjet printer. 118 is an LF encoder and 119 is a carriage encoder, which conduct motor control by detecting operating distances and operating speeds from respective encoder signals and feedback such information to corresponding motors. 112 is a blow fan, and represents the fan built into the fixing apparatus 11 in FIG. 1. 113 likewise represents the heater 13 built into the fixing apparatus 11. 114 is a temperature sensor built into the fixing apparatus, which performs the role of detecting the temperature of hot air created by the blow fan 112 and the heater 113. 115 is an operator interface, and is made up of keys that accept key operations from an operator, and a display unit that notifies the operator of information such as errors, for example.

Next, details of control in the present embodiment will be described using the flowchart in FIGS. 5A to 5C. First, an apparatus is powered on in step 1. When a print signal is input from a host computer in step 2, it is determined whether or not duplex printing is specified in step 3. In the case where duplex printing is specified, a count of the print duty in each unit area of a page divided into 1/10 inch square units is initiated. In the case of the present embodiment, images are formed by ejecting 1200 dots per inch, and thus in the case of 1/10 inch squares, a maximum of 120×120=14400 dots is counted as 100% duty. A sheet is fed in step 5, and the passage of the sheet's leading edge is detected in step 6 by the sheet sensor provided immediately before the LF roller. If a leading edge is not detected by the sheet sensor, there is a paper jam error in step 7. If the passage of the sheet's leading edge is detected, the sheet's leading edge runs into the LF roller nip, and is then additionally conveyed 3 mm to create a sheet loop (step 8).

Due to this loop, diagonal conveyance of a sheet, also called skewing, is prevented. After loop creation, the LF roller is rotated, while a rotation count by the LF encoder is contemporaneously started in step 9. Since the count is initiated from a state wherein the leading edge has run into the nip, the position of the sheet in the conveyance direction can be accurately detected. In step 10, a count of dwell times in the fixing apparatus for each 1 inch area in the conveyance direction is started for printing on the front side of the sheet. In the present embodiment, there are 0.2 inches (5.1 mm) from the LF nip to the fixing apparatus entrance, and the length of the furnace in the conveyance direction is set to 3 inches (76.2 mm). A timer is started once the sheet's leading edge enters the furnace, and the dwell time in the furnace for each 1 inch area in the conveyance direction can be calculated from the times of the furnace enter timings and exit timings for each conveyance area. More accurately, there is a possibility that the dwell times in each 1 inch area may differ, but by taking the average of the times between when the upstream and downstream positions of each area enter and exit the furnace, control is not problematic. In step 11, front side printing is conducted while also conducting the dwell time count. In step 12, it is determined whether or not a front side printing end signal exists, and if printing ends the sheet is conveyed by a discharging roller in step 13 until the sheet's trailing edge enters the furnace. In step 14, it is determined by the sheet sensor whether or not the sheet's trailing edge has exited and there is no sheet. In the case where there is a sheet, a paper jam error is determined in step 15. In the case where there is no sheet, it is determined that the sheet is being conveyed normally, and in step 16 the sheet size is determined. It is possible to determine the size by encoder count and sheet sensor trailing edge detection from the state wherein the sheet's leading edge has run into the LF nip. In step 17, required dwell times in the fixing furnace for a plurality of regions are determined for each 1 inch area in the conveyance direction after reversal of the sheet. This is based on the maximum duty and area number of the 1/10 square unit areas (first side unit printing regions) in the 1 inch areas in the conveyance direction, and the counts of the sheet dwell times in the fixing furnace for each 1 inch area in the conveyance direction (each division unit region) that were started in step 10.

The following may be given as factors that determine the required dwell times.

(1) The duty corresponding to ink ejection amounts in each of the plurality of regions per inch into which the first side is divided in the conveyance direction
(2) The respective positions in the conveyance direction of the plurality of regions on the first side
(3) The respective times between printing and reversal for the plurality of regions on the first side
(4) The respective dwell times during which the plurality of regions on the first side dwell in the fixing furnace Regarding (1), the required dwell time increases as the maximum print duty increases.

Regarding (2) and (3), there is a relationship wherein the time from printing to reversal shortens as the ink ejection position on the sheet during front side printing approaches the trailing edge. The required dwell time increases as the position approaches the trailing edge, or in other words as the time from printing to reversal shortens.

Regarding (4), the required dwell time increases as the dwell time in the fixing furnace of each 1 inch area shortens.

In step 18, the above plurality of factors are used to determine a conveyance speed Vr that can ensure at least the required dwell time. More specifically, when respective 1 inch areas have entered 3 inches inside the furnace in the conveyance direction, a maximum of four areas have entered the furnace, and thus the conveyance speed is taken to be that corresponding to the area among these areas with the longest required dwell time. For example, consider the case of a page having text or another low duty image at the sheet's trailing edge, a solid image in the middle, and text at the leading edge when printing the front side. In this case, a conveyance speed yr is determined such that the speed decreases immediately before the 1 inch areas containing portions of the solid image enter the heater, and also such that the speed increases immediately after the solid image exits the furnace. In step 19, the sheet is reversed, and in step 20, reverse conveyance is conducted while variably controlling Vr in practice. In step 21, the passage of the leading edge of the reversed sheet is detected by the sheet sensor similarly to step 6. If a leading edge is not detected by the sheet sensor, there is a paper jam error in step 22. If the passage of the sheet's leading edge is detected, a loop is created similarly to step 8, a rotation count by the LF encoder is started in step 23, and (back side) printing is conducted in step 29. In step 25, the presence or absence of a discharging signal is checked. If absent, printing is continued. If present, a sheet is discharged in step 26. In step 27, the furnace is powered off and the process ends. In the case where one-sided printing is specified in step 3, a sheet is discharged in step 20, otherwise the flow is the same as that described above, and thus further description thereof is omitted.

In the present embodiment, required post-reversal dwell times are determined on the basis of the respective factors of the maximum print duty, the position or time to reversal for 1 inch areas on a sheet, and the dwell time. However, it is not strictly necessary to use all factors. Effects are obtained even when configuring an embodiment to variably control conveyance speed on the basis of at least one of the above factors depending on the ink or sheet properties and the fixing furnace drying performance.

In the foregoing description, area numbers in the conveyance direction are divided into four levels and taken to be one factor in determining required dwell times. This entails that it is necessary to also change the required dwell times according to the ink ejection positions on the sheet during front side printing, because the time from printing to reversal changes. However, time management from printing to reversal is not limited to position detection on a sheet. A reversal start time counter that computes the time from ejection during front side printing to reversal may be provided, and the time between when ink is ejected in each of the conveyance areas 1 to 11 to when a sheet is reversed may also be counted. Required post-reversal dwell times can be determined using a table similar to FIG. 4 by combining this time information with the same duty information and fixing dwell time information as the first embodiment. In practice, differences in reversal start times occur depending on the position inside the respective conveyance areas, but by taking the average of the reversal start times at the upstream and downstream positions of each area, control is not problematic.

Herein, it is also possible to control the conveyance speed of a sheet after the sheet is reversed on the basis of the computed reversal start times, or in other words, the computed results from the reversal start time computing means, according to at least one of the respective computed results from the reversal start time computing means, dwell time computing means, and duty computing means, as well as detected results from position detecting means.

As described above, according to a control unit, the printed region of a sheet whose first side has been printed by a printing unit passes through a fixing unit, and then the conveyance direction of the sheet is reversed to print the second side, and the printed region once again passes through the fixing unit. Then, the conveyance speed of the sheet is variably controlled by using at least of the plurality of factors described earlier when the printed region once again passes through the fixing unit. Thus, the time required to fix ink is shortened and throughput is improved without producing uneven fixing.

(Second Embodiment)

Figure 6:
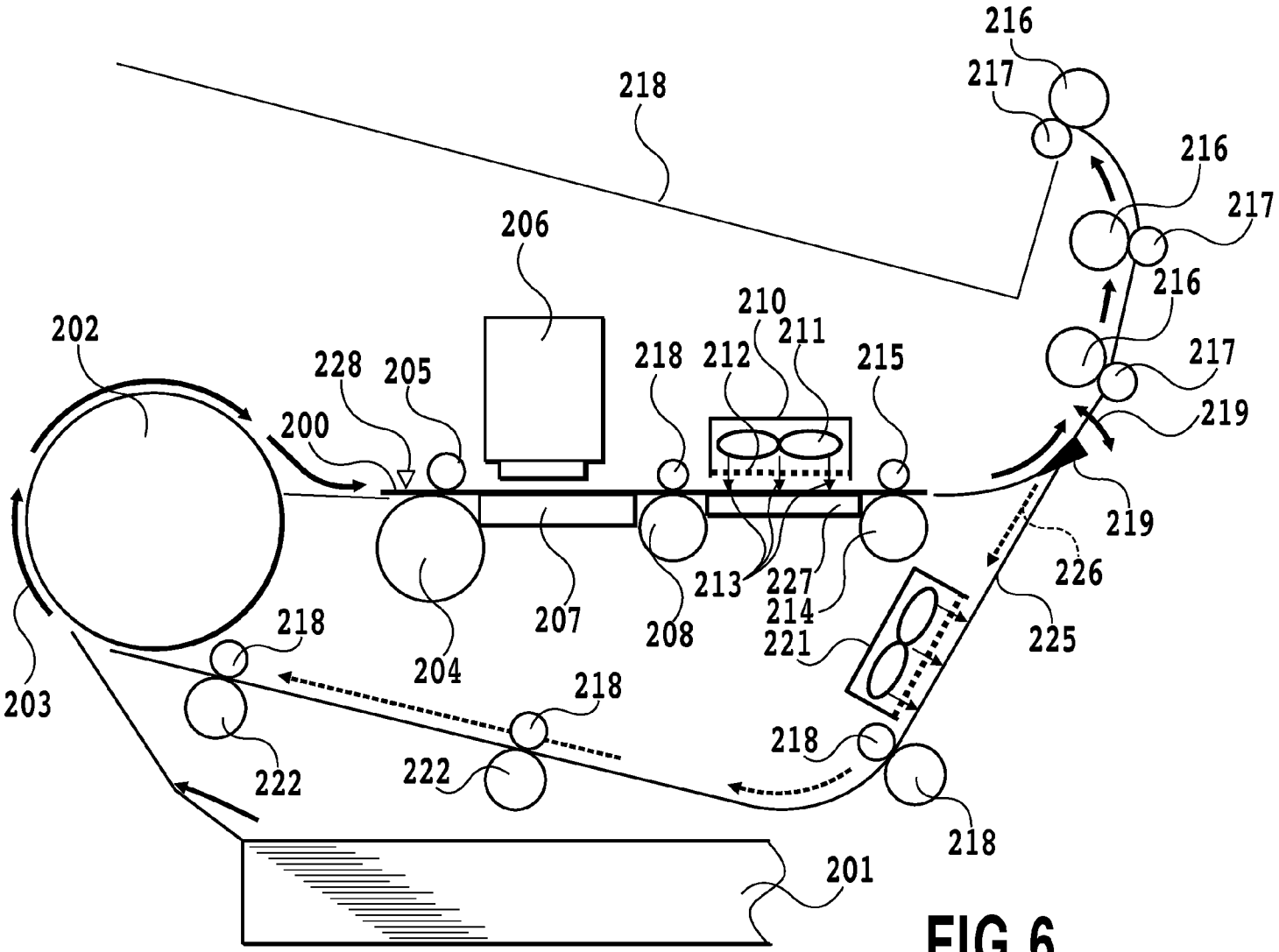
FIG. 6 is a schematic diagram illustrating a fixing apparatus and the vicinity of a duplex reversal unit in a printer of the second embodiment.

FIG. 6 is a schematic diagram of a fixing furnace and the vicinity of a duplex reversal unit in an inkjet printer of the second embodiment as viewed from the side. In FIG. 6, 200 is a sheet. A maximum of 250 sheets can be set in a feed cassette 201. One sheet at a time is picked up by a feed roller and separating means not illustrated. 202 is a U-turn conveyance unit which, together with a passive conveyance roller not illustrated, conveys a sheet in the direction of the solid arrows 203. This U-turn conveyance unit 202 also doubles as a duplex reversal unit. A sheet 200 fed along the solid arrows 203 is held between an LF roller 204 and a pinch roller 205, and conveyed directly underneath a print head 206. An LF encoder not illustrated is coaxially coupled to the LF roller 209, and is able to detect at a resolution of 1/2400 inch by converting rotation of the LF roller 204 into sheet feed distance. 228 is a sheet passage sensor (hereinafter, sheet sensor) disposed immediately before the LF roller 204, which is able to optically detect the passage of the leading and trailing edges of a sheet. 207 is a platen which supports a sheet from below. 208 is a first discharging roller which, together with a first passive roller 209, holds and conveys a sheet 200 that has passed directly underneath the print head 206. 210 is a first fixing furnace which internally includes a blow fan 211 and a Nichrome wire heater 212, similarly to the first embodiment. From the fixing furnace 210, hot air of a given temperature, such as 80° C., for example, is vertically blown onto a sheet in the direction of the arrows 213, causing ink on the sheet to dry. A temperature sensor (thermistor) not illustrated is internally built into the fixing furnace 210 and detects the hot air temperature. The length of this fixing furnace 210 in the conveyance direction is 3 inches, for example. 214 is a second discharging roller provided on the downstream side of the fixing furnace, which, together with a second passive roller 215, holds and conveys a sheet 200 that has passed through the fixing furnace 210. 227 is a discharging platen provided opposite the fixing furnace 210, which supports a sheet from below, similarly to the platen 207. A sheet guide 224 is provided on the downstream side of the second discharging roller 214. Three roller pairs which are made up of a discharge roller 216 and a passive discharge roller 217 provided along this guide hold and discharge a sheet 200, respectively. A discharged sheet is discharged into a discharge tray 218 with its printed side down, also called face down.

During duplex printing, a sheet 200 is conveyed by the respective rollers until its trailing edge clears a duplex pass switching unit 219, and is temporarily stopped. In this state, the duplex path switching unit 219 is operated in the counterclockwise direction of the arrow 220, thus opening the duplex conveyance path 225. After that, when the roller system is reversed, a sheet 200 is led along the duplex conveyance path 225 and conveyed in the direction of the broken arrows 226.

221 is a second fixing furnace provided on the duplex conveyance path, and is a unit with the same construction as the first fixing furnace 210. A fixing unit is realized by these two fixing furnaces 210 and 221 provided at different locations. A conveyed sheet 200 is once again dried when it passes through the fixing furnace 221. After that, the sheet is held by three roller pairs made up of a duplex conveyance roller 222 and a passive duplex roller 223, and returned to the U-turn conveyance unit 202. Then, the sheet is conveyed along the solid arrow 203, wound around the U-turn conveyance unit 202, and once again held between the LF roller 209 and the pinch roller 205. At this time, the sheet 200 is reversed front to back, with the printed side facing down. After that, back side printing is conducted similarly to front side printing, the sheet is discharged into the discharge tray 218 via the fixing furnace, and printing of a single page ends.

Details regarding the control configuration for executing print control of an inkjet printer are similar to the first embodiment, and since the configuration only differs in that there are now two each of the blow fan, heater, and temperature sensor constituting a fixing furnace, further description thereof is omitted.

(Third Embodiment)

The third embodiment is a configuration that adds to the first embodiment a function enabling the operator to specify a drying fixing level that prescribes the degree of drying of a sheet onto which ink has been ejected.

Figure 7:
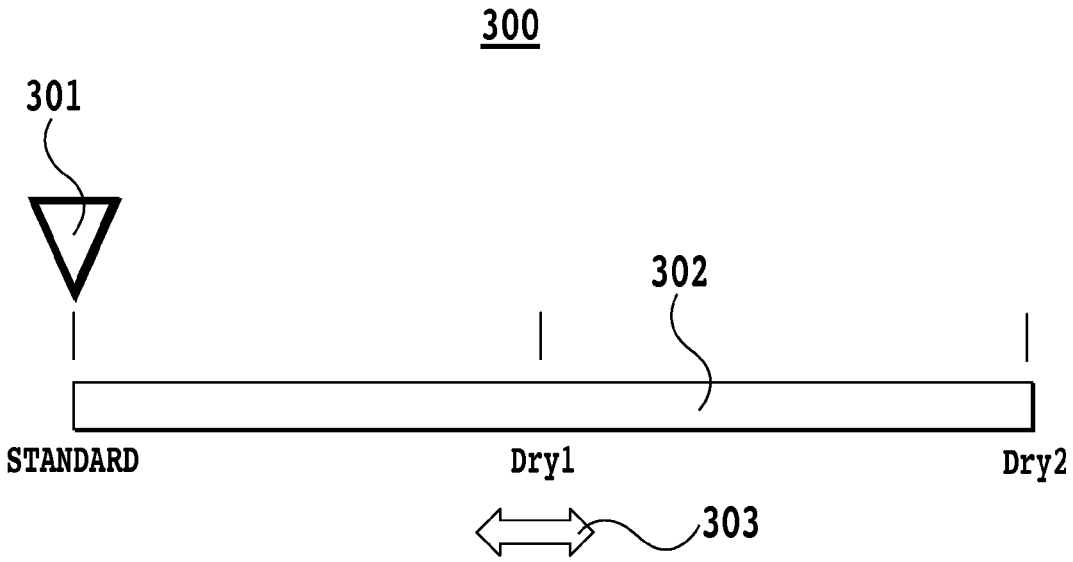
FIG. 7 illustrates a screen for specifying a drying fixing level in the second embodiment.
Figure 8:
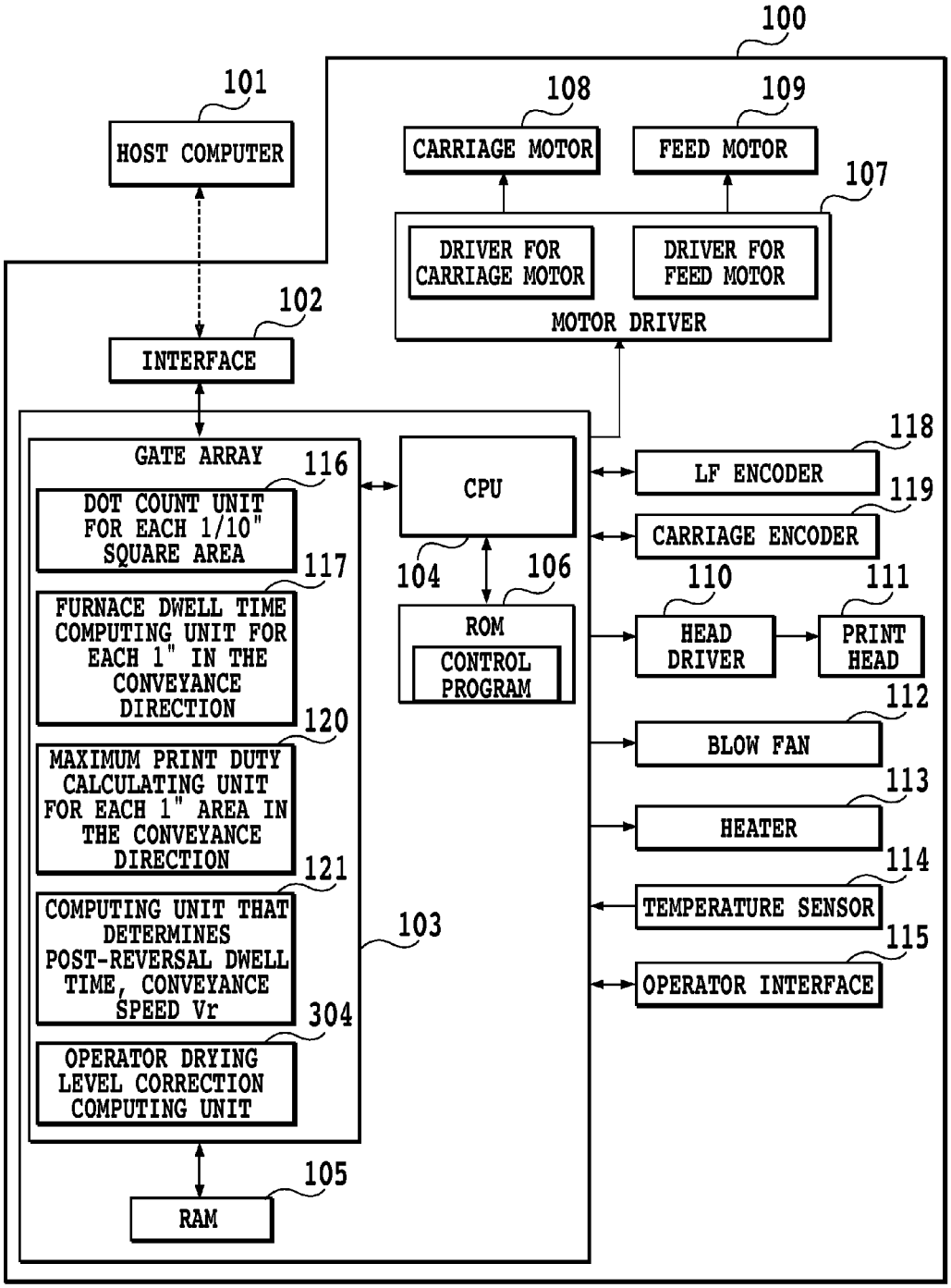
FIG. 8 is a block diagram illustrating a control configuration in a third embodiment.

FIG. 7 illustrates an exemplary screen for when the operator specifies a drying fixing level on a printer driver screen on a host computer. FIG. 8 is a block diagram illustrating a control configuration in the present embodiment. Regarding FIG. 8, only the portions that have been added to the block diagram in FIG. 2 described in the first embodiment are described, while the same reference numbers are used for the same function units as FIG. 2.

In FIG. 7, 300 is a settings diagram for when a drying level settings screen is opened from a printer settings screen on a host computer. Using a mouse or other device, a pointer 301 can be aligned with the three stages "Standard", "Dry 1", and "Dry 2" in the direction of the arrow 303 along a drying level bar 302.

In FIG. 8, when a setting of the arrow 303 is sent from the host computer 101 via the interface 102, that information is stored in the RAM 105, and that setting is applied to an operator drying level correction computing unit 304 inside the gate array. A required post-reversal dwell time in the fixing furnace and a reversal speed Vr that realizes that dwell time is determined by a computing unit 121 from information from the computing unit 117 that computes dwell times, information from the maximum print duty calculating unit 120, and information from the operator drying level correction computing unit 304.

FIGS. 9A and 9B are tables for determining required dwell times. Required dwell times for each of the areas 1 to 11 are determined in accordance with this table, and stored as information in the RAM 105. This table adds a correction to FIGS. 4A and 4B that were used when describing the first embodiment. In the case of the operator setting "Dry 1", 0.5 s is uniformly added to the required post-reversal dwell times. In the case of "Dry 2", 1 s is added.

Even with standard settings, dwell times are set such that ink stains and white streaks do not occur. However, the impression of how moist a sheet feels differs depending on the operator's preferences, temperature and humidity conditions during use, and the type of sheet. Consequently, providing an operator setting as in the present embodiment has the advantage of enabling the operator to select the quality as printed material.

(Fourth Embodiment)

Figure 10:
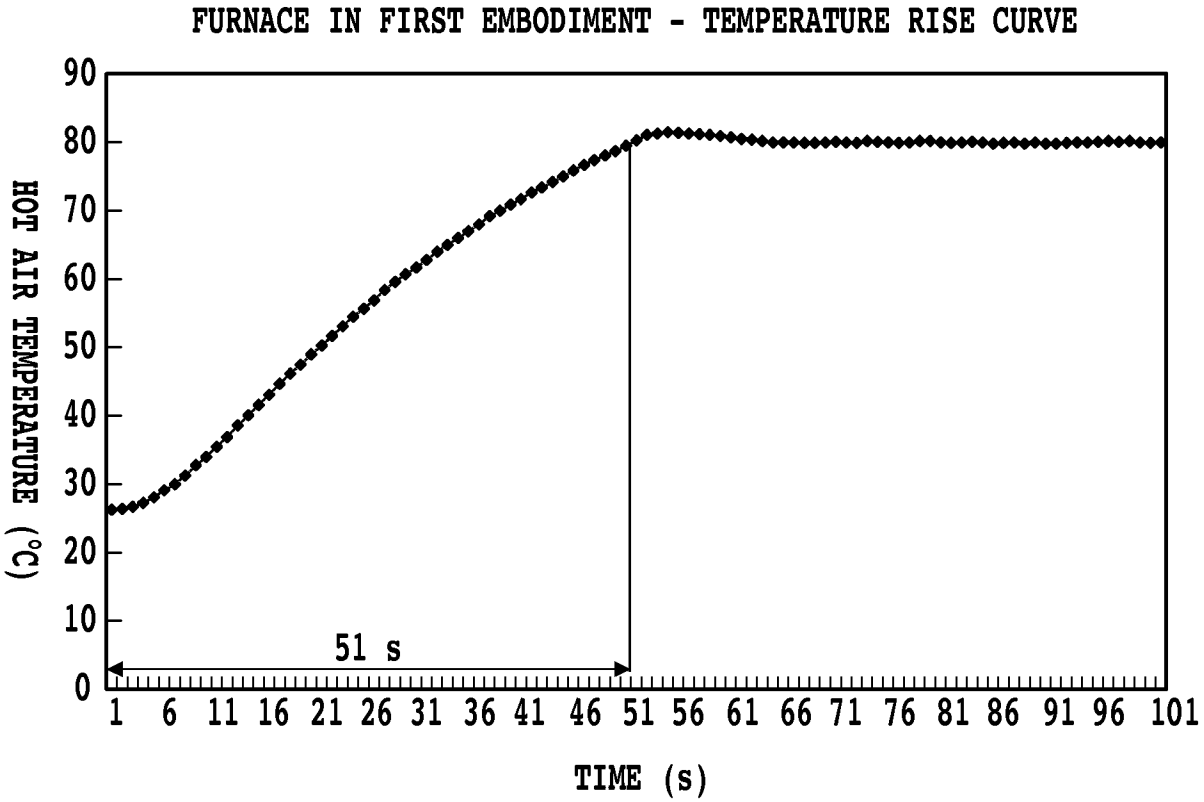
FIG. 10 is a graph illustrating a fixing apparatus hot air temperature rise curve in a fourth embodiment.

In the first embodiment, the fixing furnace is made up of a blow fan 112, a heater 113, and a temperature sensor 114, as described using the lateral view in FIG. 1 and the block diagram in FIG. 2. In the first embodiment, hot air at a given temperature of 80° C. is generated and blown onto a sheet. For this reason, time is required for raising the temperature from the ambient temperature to 80° C., and a temperature rise curve like that in FIG. 10 is obtained with the fan and heater used in the present embodiment. In FIG. 10, 51 s are required in order to raise the temperature from an ambient temperature 26° C. to 80° C. In the present embodiment, since this fixing warm up time is long compared to the feed and carriage initialization times, it imposes a limitation on the first print wait time.

In contrast, there are also cases where a hot air temperature of 80° C. is unnecessary, depending on the first print image. In particular, white streaks or stains do not occur even without a fixing furnace when given images of 25% duty or less and made up of mostly text and graphs which occupy the majority of most office documents. Consequently, varying the wait time according to image duty is effective for ensuring operator convenience.

Figure 11:
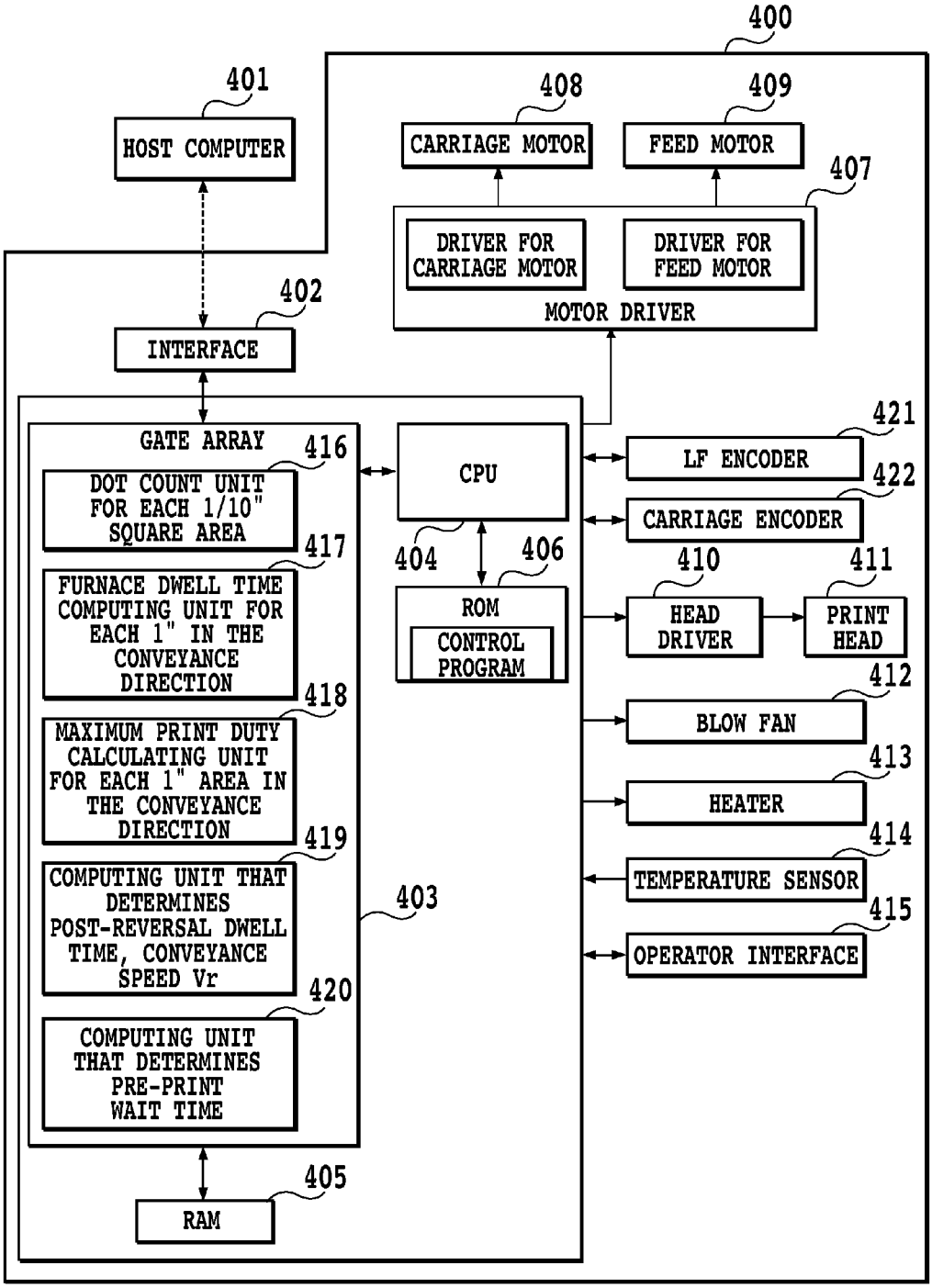
FIG. 11 is a block diagram illustrating a control configuration in the fourth embodiment.

FIG. 11 is a block diagram illustrating a control configuration of the present embodiment. 400 is an inkjet printer. 402 is an interface 102 provided in the printer which couples the inkjet printer 400 and a host computer 401, receiving print data from the host computer 401 and sending back various status information to the host computer 401. 403 is a gate array, 404 is a CPU, 405 is RAM, and 406 is ROM. When print data is sent from the host computer 401, the data is temporarily stored in the RAM 405 via the gate array 403. After that, the print data is converted from raster data to a print image by the gate array 403, and once again stored in the RAM 405. In the present embodiment, there is installed page memory with a capacity able to store a print image for one page. A print image is sent to a print head 411 via the gate array 403 and a head driver 410, and printing is conducted by ejecting ink from the head.

A dot count unit 416 is packaged on the gate array 403, and is able to count numbers of ejected dots in individual unit areas. Hereinafter, a computing unit 417 that computes dwell times in a fixing furnace, a calculating unit 418 that calculates maximum print duty, and a computing unit 419 that determines a reversal speed Vr have the exact same functions as the first embodiment, and thus further description thereof is omitted.

The present embodiment likewise carries out area division like that illustrated in FIG. 3. Although the area division method is the same as the first embodiment, area definition for one page is carried out before printing starts, and stored in the RAM 405.

420 is a computing unit that determines a pre-print wait time from the computed results from the calculating unit 418 that calculates maximum print duty. More specifically, the computing unit 420 determines a wait time in accordance with a wait time determination table as in FIG. 12. In the present embodiment, after a print signal expressing a printing start command is transmitted from the host 401, respective initializations, data conversion, feed operations, etc. take approximately 15 s. If a fixing furnace is turned on contemporaneously with the print signal transmission, its temperature rises to approximately 40° C., as can be seen in FIG. 10. Demonstrations of fixing effects show that even if the ambient temperature changes, fixing effects are nearly the same if the difference between the ambient temperature and hot air temperature is the same. Consequently, if the time since turning on fixing is the same, nearly the same fixing effects are obtained regardless of ambient conditions. In the present embodiment, an ambient temperature of 26° C. is presumed.

According to FIG. 12, in the case where the duty is 100% or less in the conveyance direction areas 1 to 3, a 35 s wait time is inserted, for example. At this time, the time until a sheet's leading edge runs directly below the fixing furnace becomes 15+35=50 s, by which time the hot air temperature has nearly risen to 80° C. This is the maximum wait time, with shorter waits of 33 s, 31 s, and 29 s being set as the areas approach the trailing edge. Wait times are set in this way because, for areas near the trailing edge, the temperature at the time of entry increases due to the print time and feed time. Also, an ink absorbance capacity exists for a sheet, and if a certain degree or more or ink is applied, the ink will no longer be absorbed and will spill out over the sheet. Consequently, although also dependent on the sheet type, in the case of a duty of approximately 40% or less, ink does not spill even without a fixing furnace, and problems such as stains do not occur. Wait times are also configured while taking ink absorbance capacity into account. Instead of a proportional relationship between duty and wait time, wait times are set to increase on a sharper curve once the duty exceeds around 50%. In so doing, a necessary wait time for each area (each division region) is retrieved, and the longest among those times is adopted as the final wait time.

ROM 406 is a read-only device which stores various programs such as printer control programs. These control programs are referenced by a CPU 404 to conduct control operations.

407 is a motor driver, and is a control circuit for controlling a carriage motor 408 and a feed motor 409 that conduct print operations of a serial inkjet printer. 421 is an LF encoder and 422 is a carriage encoder, which conduct motor control by detecting operating distances and operating speeds from respective encoder signals and feed back such information to corresponding motors. 412 is a blow fan, and 413 is a heater. 414 is a temperature sensor built into the fixing furnace, which performs the role of detecting the temperature of hot air created by the blow fan 412 and the heater 413. 415 indicates an operator interface, and it is made up of keys that accept key operations from an operator, and a display unit that notifies the operator of information such as errors, for example.

Figure 5B:
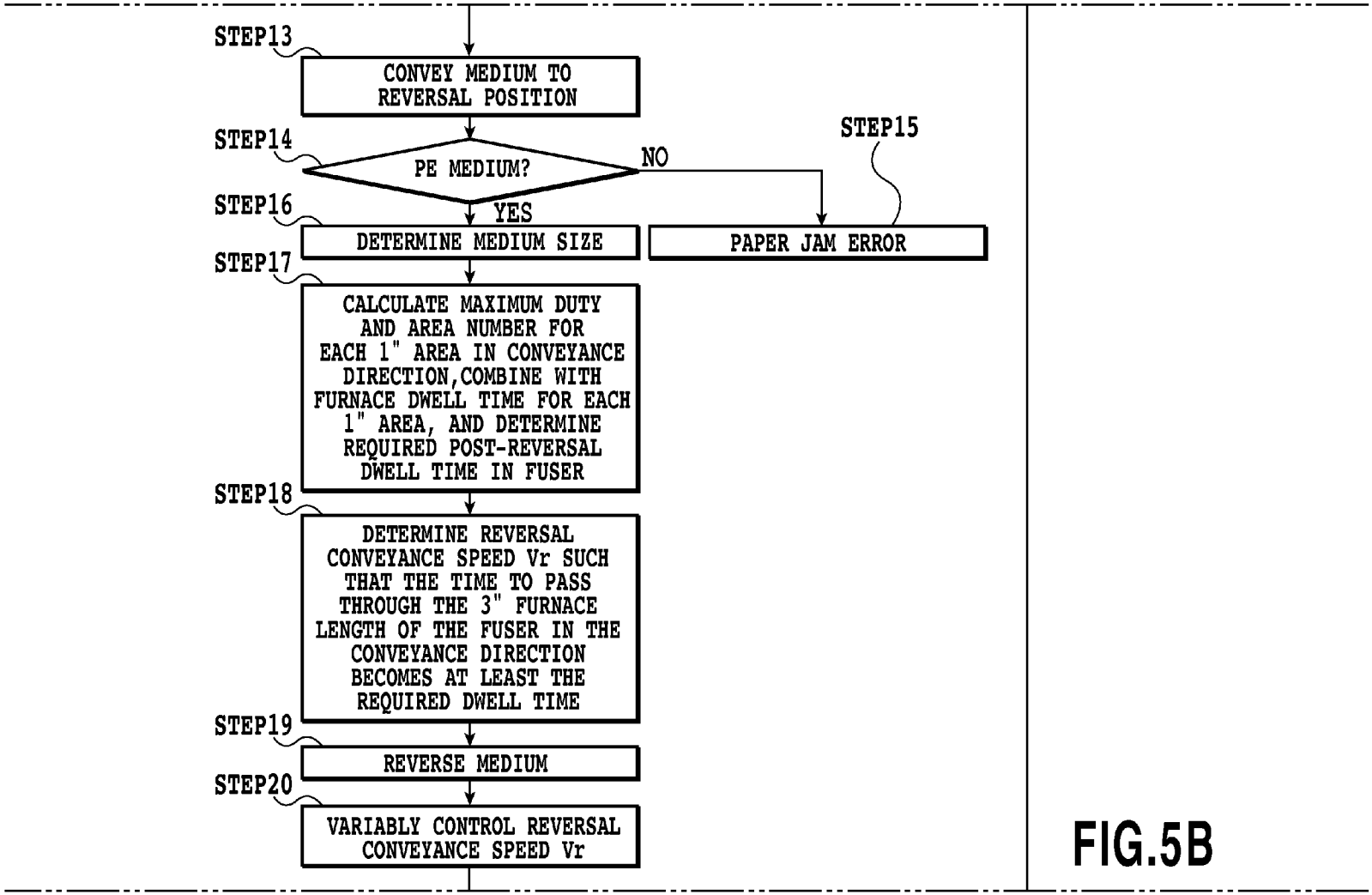
Figure 5C:
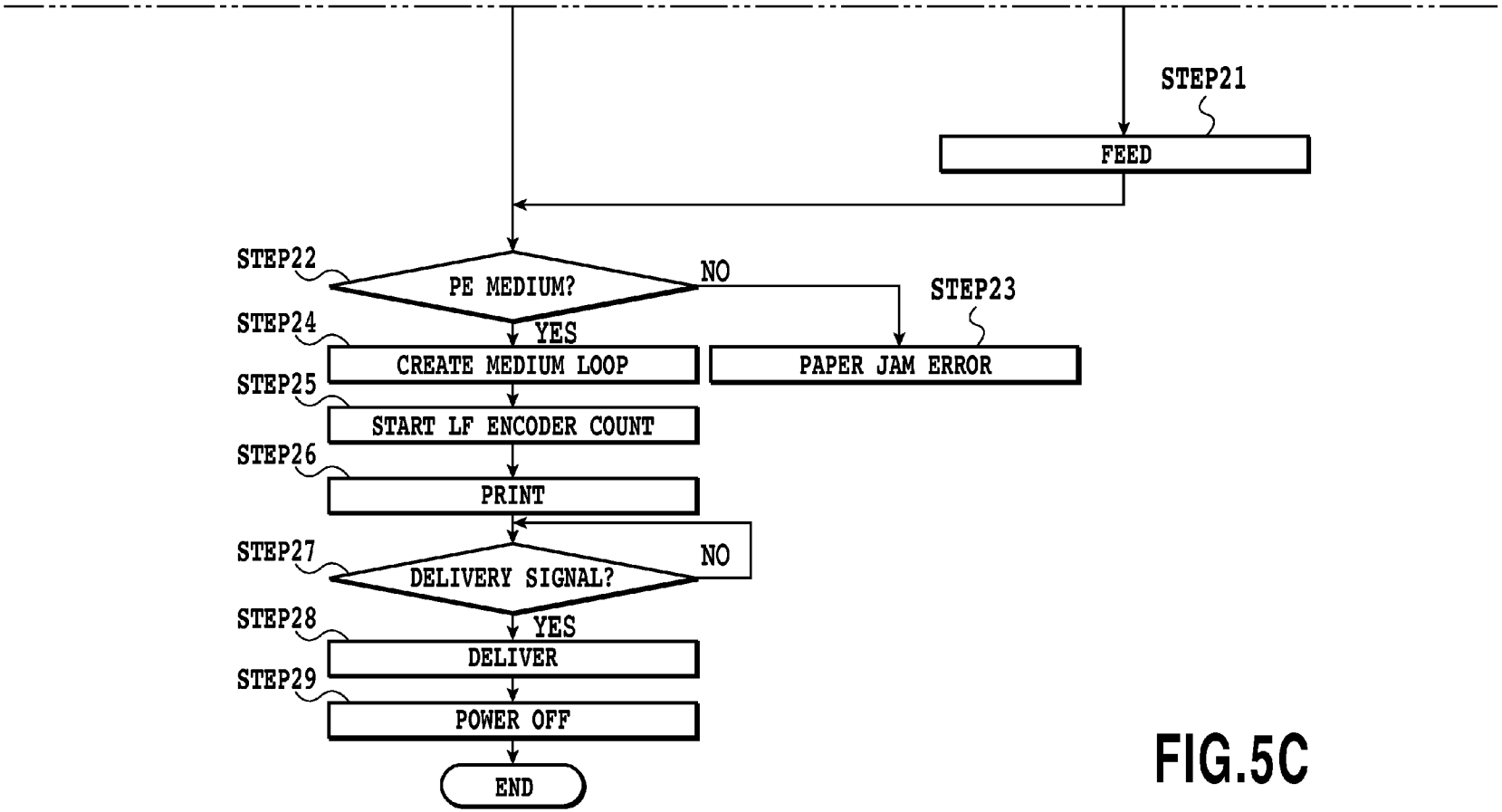

The operational flow is the same as the flowcharts in FIGS. 5A to 5C for the first embodiment, except that a wait time is determined by the control configuration of the block diagram described above, and the wait time is inserted after a print signal is input and before feeding. For this reason, a detailed description is omitted.

In the present embodiment, a wait time is calculated according to the maximum duty in each area in the conveyance direction which is calculated on the basis of duty levels. However, the present invention is not limited to this control configuration.

Instead of a memory configuration based on area division in the conveyance direction, maximum duty may be calculated in page units, and a wait time may be determined from the time required to fix that maximum duty portion. Fine control according to the print position on a sheet as in the present embodiment cannot be conducted, but fixing effects are realizable with a simple control configuration by setting an extra margin on top of the wait time.

Also, in order to conduct more accurate control, a predicted time when each area will arrive at the fixing furnace may be computed in advance, and the maximum duty/arrival time (the ratio of duty to arrival time) may be calculated from the maximum duty and arrival time for each area. A wait time may then be determined on the basis of the maximum value for the ratio on that page. In this case, arrival times at the fixing furnace are computed in advance while also taking into account the print mode during printing (single pass or multi-pass), raster skip, and the size of the carriage scan width. For this reason, this configuration has the merit of enabling more accurate determination of required wait times than with position information for area division.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-105696, filed Apr. 30, 2010, which is hereby incorporated by reference herein in its entirety.

What is claimed is:

1. An inkjet printing apparatus capable of printing on a first side and a second side of a sheet, comprising:

an inkjet head configured to print an image onto the sheet;

a heating unit configured to heat the printed sheet at a heating area;

a conveying unit configured to convey the sheet; and a controller configured to control the inkjet head and the conveying unit such that:

(i) the inkjet head prints on the first side of the sheet, (ii) the conveying unit conveys a printed region of the sheet downstream through the heating area, and then reverses the conveyance of the sheet and conveys the printed region back through the heating area again, (iii) the inkjet head then prints on the second side of the sheet, and (iv) the conveying unit conveys the sheet downstream through the heating area, wherein the controller is further configured to, when the conveyance of the sheet is reversed and the printed region passes through the heating area again, change respective dwell times within the heating area for each of a plurality of divided unit areas of the printed region such that the more downstream a unit area is, the shorter the dwell time.

2. The inkjet printing apparatus of claim 1, wherein a size of each of the unit areas is smaller than the heating area in a conveyance direction of the sheet.

3. The inkjet printing apparatus of claim 1, wherein the controller is further configured to set the respective dwell times for each of the unit areas using information related to print duties corresponding to ink ejection amounts in each unit area.

4. The inkjet printing apparatus of claim 3, wherein the controller is further configured to control a conveyance speed according to the set dwell times.

5. The inkjet printing apparatus of claim 4, wherein the controller is further configured to control the conveyance speed using information on a drying level specified by an operator.

6. The inkjet printing apparatus of claim 1, wherein the heating unit further comprises:

a furnace disposed downstream of the inkjet head, wherein the sheet passes through the furnace three times.

7. The inkjet printing apparatus of claim 1, wherein the controller is further configured to modify a wait time before starting a printing operation in response to receiving a printing start command, in accordance with a duty corresponding to an ink ejection amount in a unit printing region on the first side, in a state where the heating unit has not reached a given temperature.

8. An inkjet printing apparatus comprising:

an inkjet head configured to print an image onto a sheet;

a heating unit configured to heat the printed sheet at a heating area;

a conveying unit configured to convey the sheet; and a controller configured to control the conveying unit such that a printed region of the sheet, once conveyed downstream through the heating area, is subsequently conveyed back through the heating area, wherein the controller is further configured to, when the printed region passes through the heating area while being subsequently conveyed back through the heating area, change respective dwell times within the heating area for each of a plurality of divided unit areas of the printed region such that the more downstream the unit area is, the shorter the dwell time.

9. The inkjet printing apparatus of claim 8, wherein a size of each of the unit areas is smaller than the heating area in a conveyance direction.

10. The inkjet printing apparatus of claim 9, wherein the controller is further configured to set the respective dwell times for each of the unit areas using information related to print duties corresponding to ink ejection amounts in each unit area.

* * * * *